US005410892A

United States Patent [19]

Catoe et al.

[11] Patent Number: 5,410,892

[45] Date of Patent: May 2, 1995

[54] HORIZONTAL WET TREATMENT MACHINES FOR TEXTILES AND TEXTILE MATERIAL CARRIERS THEREFOR

[75] Inventors: Robert L. Catoe; Matthew A. Meeker; James K. Turner; Thomas W. Van Scyoc, all of Stanley, N.C.

[73] Assignee: Gaston County Dyeing Machine Company, Stanley, N.C.

[21] Appl. No.: 49,835

[22] Filed: Apr. 19, 1993

[51] Int. Cl.[6] ..... D06B 5/18

[52] U.S. Cl. ..... 68/189; 68/198

[58] Field of Search ..... 68/187, 188, 189, 194, 68/198, 199

[56] References Cited

U.S. PATENT DOCUMENTS

| | | | |
|---|---|---|---|
| 1,334,526 | 3/1920 | Dudley | 68/189 X |
| 2,562,220 | 7/1951 | Stienen | 68/188 |
| 3,344,622 | 10/1967 | Kronsbein | 68/189 X |
| 3,596,481 | 8/1971 | Wilcox | 68/198 X |
| 4,452,055 | 6/1984 | Lejeune et al. | 68/189 |
| 4,825,668 | 5/1989 | Villard et al. | 68/189 |
| 4,884,418 | 12/1989 | Barriquand et al. | 68/189 X |
| 5,172,443 | 12/1992 | Christ | 68/189 X |

FOREIGN PATENT DOCUMENTS

| | | | |
|---|---|---|---|
| 0110058 | 1/1987 | European Pat. Off. . | |
| 35694 | 7/1886 | Germany | 68/189 |
| 156359 | 1/1921 | United Kingdom | 68/187 |
| 1018580 | 1/1966 | United Kingdom . | |
| 2062036 | 5/1981 | United Kingdom . | |

*Primary Examiner*—Philip R. Coe
*Attorney, Agent, or Firm*—Shefte, Pinckney & Sawyer

[57] ABSTRACT

A horizontal package dyeing machine in which yarn packages are supported in carriers that have a base with tubular posts projecting therefrom for stacking yarn packages thereon and a wall secured to and extending upwardly from the periphery of the base to form an enclosure for confining treating liquid. The base is formed with two liquid distribution chambers, one being an upper chamber communicating with the interior of the posts and the other being a lower chamber communicating with the interior of the enclosure. The distribution chambers have open ends that can communicate with liquid supplying and withdrawing ducts of the machine for circulation of treating liquid within the carrier enclosure. The carriers are dimensioned for positioning two carriers in a vessel with the open ends of the distribution chambers in communication for flow of treating liquid therebetween. The open end of the discharge chambers of a carrier at the opening end of the vessel has its discharge chamber ends blocked by a positioning member on the lid of the vessel. An insert member may be used in place of a second carrier when dyeing a half batch of yarn packages or less, with the insert member having a flow blocking surface disposed against the distribution chamber openings at the adjacent end of the adjacent carrier and having its other end against the positioning member of the lid of the vessel.

18 Claims, 13 Drawing Sheets

HORIZONTAL WET TREATMENT MACHINES FOR TEXTILES AND TEXTILE MATERIAL CARRIERS THEREFOR

BACKGROUND OF THE INVENTION

The present invention relates to textile wet treatment machines and more particularly to horizontal wet treatment machines for textiles and textile material carriers therefor, such as horizontal package dyeing machines and carriers for supporting yarn packages therein.

Textile dyeing machines are normally cylindrical in shape for effectively withstanding the interior pressures developed during dyeing cycles. In such dyeing machines where the cylindrical vessel is arranged vertically, the textile material to be treated, such as yarn packages supported on vertical tubes, can be arranged in a cylindrical configuration to substantially fill the cross-section of the dye vessel, but vertically arranged cylinders require substantial vertical space above the vessel for loading and unloading. On the other hand, horizontally disposed cylindrical dye vessels can be easily loaded from floor level, but the textile material is not easily arranged to fully occupy the cylindrical shape of the vessel. Rather, the arrangement of the textile material, such as yarn packages stacked on tubes, is normally rectangular in cross-section, rather than circular, thereby leaving voids between the textile material being treated and the wall and bottom of the vessel. Also, with horizontal dyeing machines, there is not normally a way of limiting the volume of treating liquid when less than a full capacity batch of textile material is being treated.

At the present time, the cost of using excess treating liquid and the accompanying environmental problems make it important to minimize to the greatest extent possible the amount of treating liquid that is used in relation to the material being treated. Attempts have been made to deal with this problem by providing interior vertical walls in the vessel itself to confine the treating liquid to the space occupied by and closely adjacent to the textile material being treated. However, such vertical walls make draining of liquid that inadvertently flows over the walls difficult and also makes it difficult to gain access for cleaning in the space between the vertical walls and the cylindrical walls of the vessel.

It is also known to use walled "dummy" carriers as inserts in horizontal dyeing machines to occupy space not needed when less than a full capacity batch of textile material is being treated. An example of such use of a "dummy" carrier is disclosed in Barriquand et al U.S. Pat. No. 4,884,418. However, the use of such "dummy" carriers, while reducing the volume of treating liquid needed, does not totally fill the space between the "dummy" carrier and the vessel walls and bottom.

Despite the improvements of the prior art, the need still exists for further reductions in the volume of liquid used to not only improve the efficiency of horizontal wet treatment machines operation but to further reduce the effluent to be disposed of after treatment.

SUMMARY OF THE INVENTION

By the present invention, a horizontal wet treatment machine and carriers for supporting textile material to be treated in the machine are provided that minimize the volume of treating liquid by the use of walled carriers that confine the treating liquid substantially to only the volume occupied by the textile material and not the unoccupied space at the sides and bottom of the vessel. Further, the present invention provides an effective way of minimizing the volume of treating liquid when treating less than a full capacity batch of textile material. In obtaining these advantages, the present invention also provides a unique arrangement for circulating the treating liquid into, through, and from the carrier.

Briefly described, the present invention provides a carrier for supporting textile material in a horizontal wet treatment machine of the type having a cylindrical vessel into which carriers supporting textile material for treatment are transported horizontally. The carrier has a base for supporting textile material thereon with a wall mounted on and extending upwardly from the periphery of the base to form therewith an enclosure for confining therewithin treating liquid for treating textile material supported therein. The carrier further has a liquid flow assembly for receiving and discharging treating liquid for circulation into and out of the carrier. Preferably, the liquid flow assembly has a plurality of openings and there is a plurality of hollow tubes vertically mounted on the base in communication with the openings and each tube has a plurality of openings through which liquid flows between the hollow interior of the tube and the exterior of the tube.

In the preferred embodiment, the vessel of the dyeing machine has a capacity for wet treating a predetermined amount of textile material and the base and wall of the carrier are dimensioned to support a load of textile material less than the predetermined capacity of the vessel, with either a second or additional carrier being capable of disposition in the vessel for simultaneous treatment of a full batch of textile material supported on the carriers, or an insert member can be utilized in place of an additional carrier to occupy the space normally occupied by another carrier for treatment of less than a full batch.

In the preferred embodiment, the liquid flow assembly includes two liquid distribution chambers formed in the base and communicating with the enclosure formed by the base and the wall for delivery of liquid into the enclosure through one of the chambers and withdrawal of liquid from the enclosure through the other of the chambers. One of the distribution chambers communicates interiorly with the support assembly openings for passage of liquid therethrough. This one distribution chamber is disposed above the other distribution chamber with the lower chamber having passages extending upwardly through the upper chamber and opening into the enclosure for passage of liquid between the lower chamber and the enclosure. Preferably, the aforementioned posts are arranged in spaced rows and the passages of the lower chamber are disposed between the rows. The distribution chambers are open at the ends of the base for communicating with corresponding machine ducts for the receipt and discharge of treating liquid and for communicating with corresponding chambers of an adjacent carrier disposed in the vessel when each carrier is of a lengthwise extent less than the carrier receiving lengthwise extent of the vessel. In the latter case, two or more carriers may be used together during simultaneous treating. Preferably, each carrier has a lengthwise extent equivalent to one-half the distance between the machine ports and positioning member of the vessel so that only one size carrier needs to be supplied.

In one form of the present invention, when using a carrier of a size less than the lengthwise carrier receiving extent of the vessel, an insert member may be utilized. Such insert member has a lengthwise extent sufficient to position the carrier against the machine ports when the insert member is disposed between the carrier and a positioning member of the machine at the opposite end of the vessel. Preferably, each carrier and each insert member have the same lengthwise extent equivalent to one-half the distance between the machine ports and the positioning member of the vessel. To prevent flow of treating liquid from the ends of the base into the enclosure, rather than through the openings and passages, the positioning member of the vessel has a flow blocking surface abutting the distribution chamber openings at the adjacent ends of the adjacent carrier. Further, to perform the same purpose, the insert member has a flow blocking surface disposed against the open ends of the distribution chambers of the base to block flow of liquid therefrom. Otherwise, the distribution chamber open ends permit flow of liquid between adjacent carriers.

Other features and advantages of the present invention are disclosed in or are apparent from the following detailed description of the preferred embodiment and in the accompanying drawings.

DESCRIPTION OF THE PREFERRED EMBODIMENTS

Figure 1:
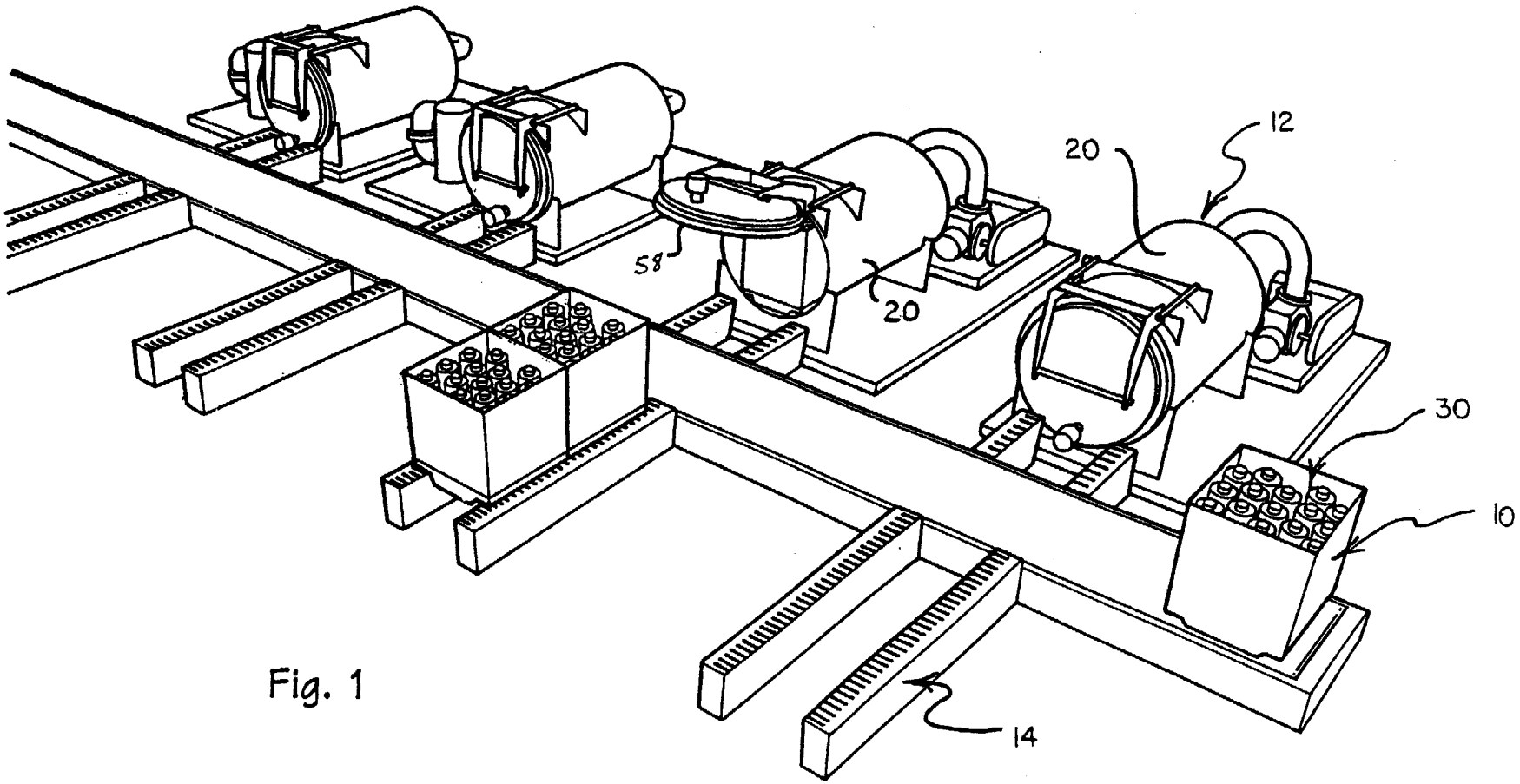
FIG. 1 is a schematic perspective view of a system for wet treatment of textile material including a plurality of horizontal package dyeing machines, a plurality of carriers for supporting textile yarn packages in the horizontal dyeing machines, and a transport assembly for transporting the carriers to and from the horizontal dyeing machines with the dyeing machine and carriers incorporating the preferred embodiment of the present invention.

As illustrated in FIGS. 1–20, a carrier 10 of the preferred embodiment of the present invention is provided for supporting textile material in the form of yarn packages 30 for transport to and from a horizontal wet treatment machine in the form of a horizontal package dyeing machine 12. The carriers 10 are independently movable on a conventional carrier transport assembly 14 to various locations in a multiple dyeing machine arrangement, as seen in FIG. 1, in which a plurality of dyeing machines 12 are arranged for receiving a plurality of the carriers 10 transported thereto on the carrier transport assembly 14.

Figure 2:
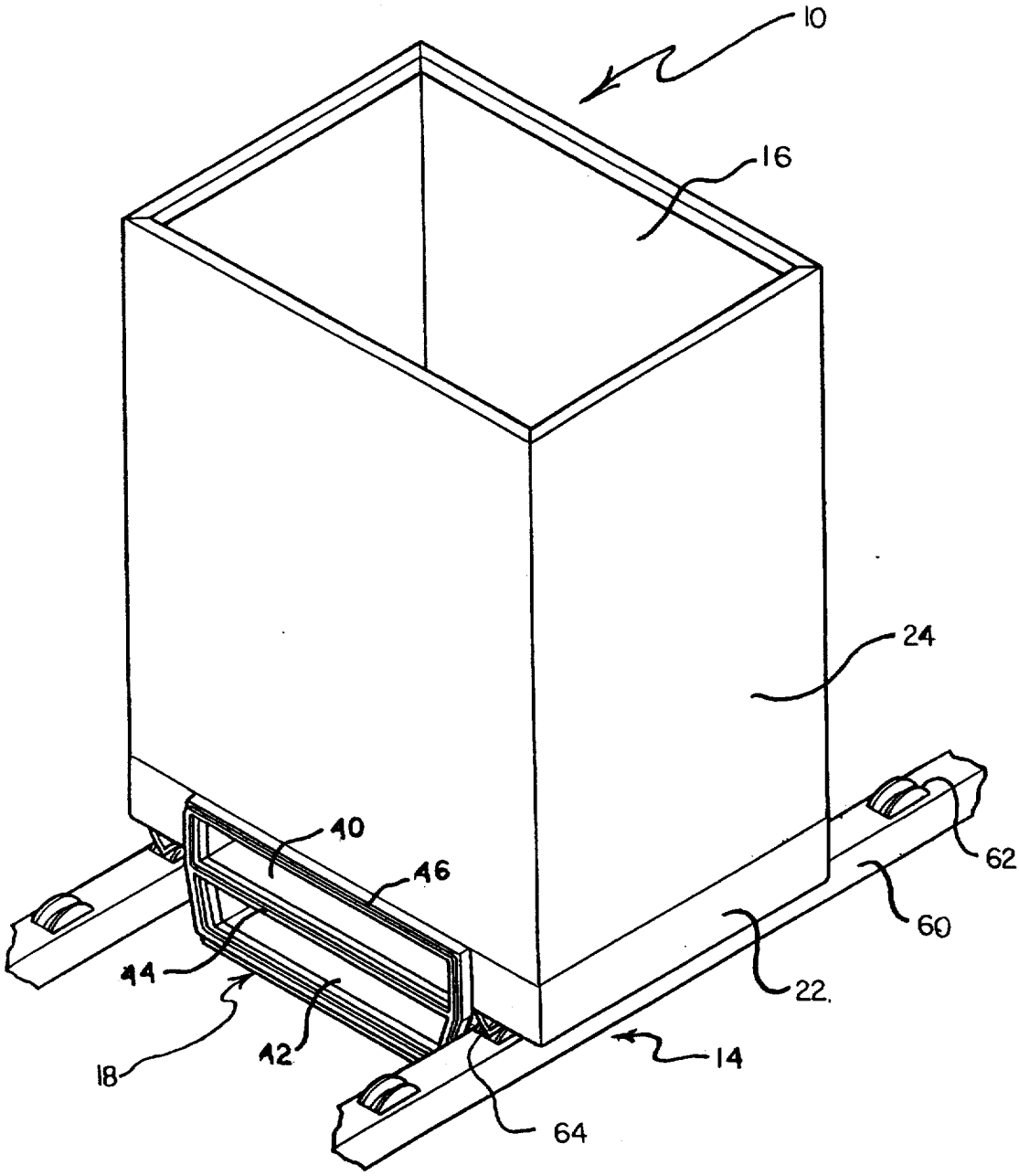
FIG. 2 is a perspective view of one of the carriers illustrated in FIG. 1 supported on a track of the transport assembly.
Figure 3:
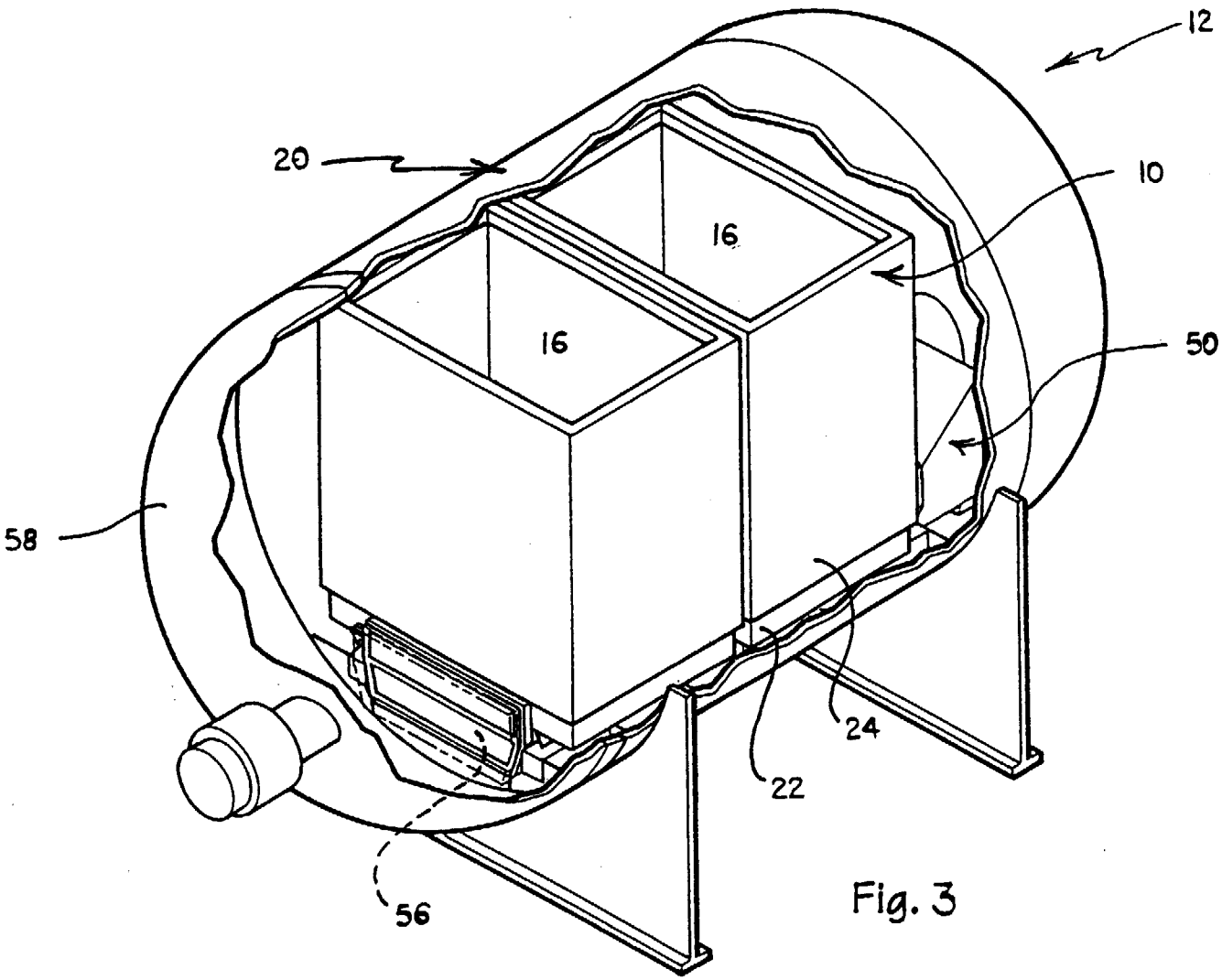
FIG. 3 is a perspective view of the vessel of one of the horizontal dyeing machines shown in FIG. 1, partially broken away, to show two of the carriers disposed therein.
Figure 4:
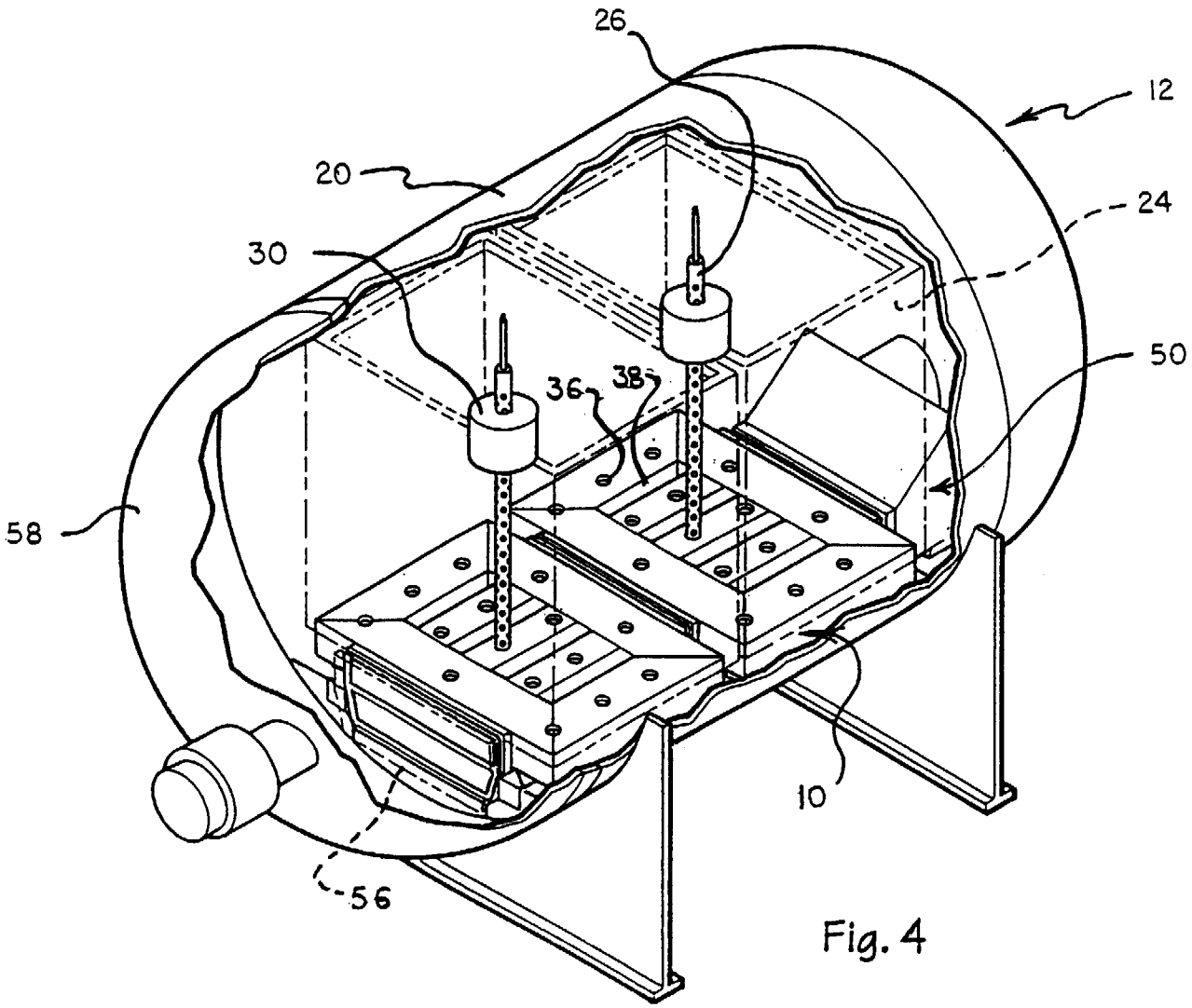
FIG. 4 is a perspective view of the vessel and the pair of carriers shown in FIG. 3 and showing details of the base of the carriers.
Figure 5:
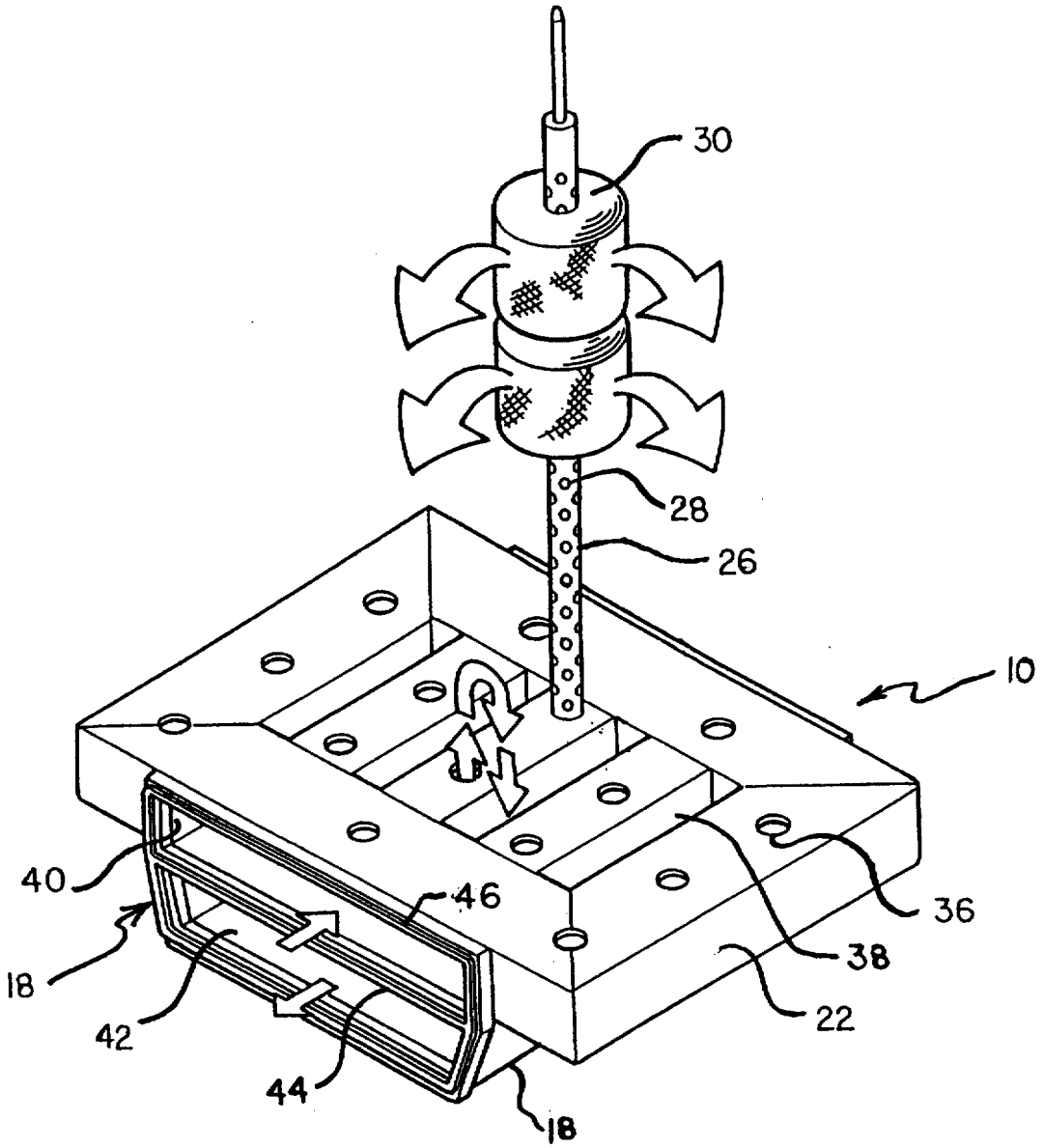
FIG. 5 is a perspective view of the base of a carrier and showing details of the liquid flow assembly of the carrier during a normal liquid circulation operation in which the liquid flows through the upper liquid distribution chamber of the flow assembly and is transferred away from the carrier by the lower liquid distribution chamber of the flow assembly.

As seen in FIG. 2, the carrier 10 includes a liquid flow assembly 18 for delivery and withdrawal flow of liquid to and through the carrier. The liquid may a dye liquor, a bleaching solution, a water wash, or any other fluid. The carrier 10 includes a base 22 and a wall 24 extending upwardly from the periphery of the base 22 and forming therewith an enclosure 16 for retaining the fluid for dyeing yarn packages 30 therein. As seen in FIG. 5, the base 20 is preferably rectangular in horizontal cross-section and, as seen in FIG. 4, the wall 24 has four flat sides. The top of the enclosure 10 is open for ease of loading yarn packages 30 therein.

Figure 8:
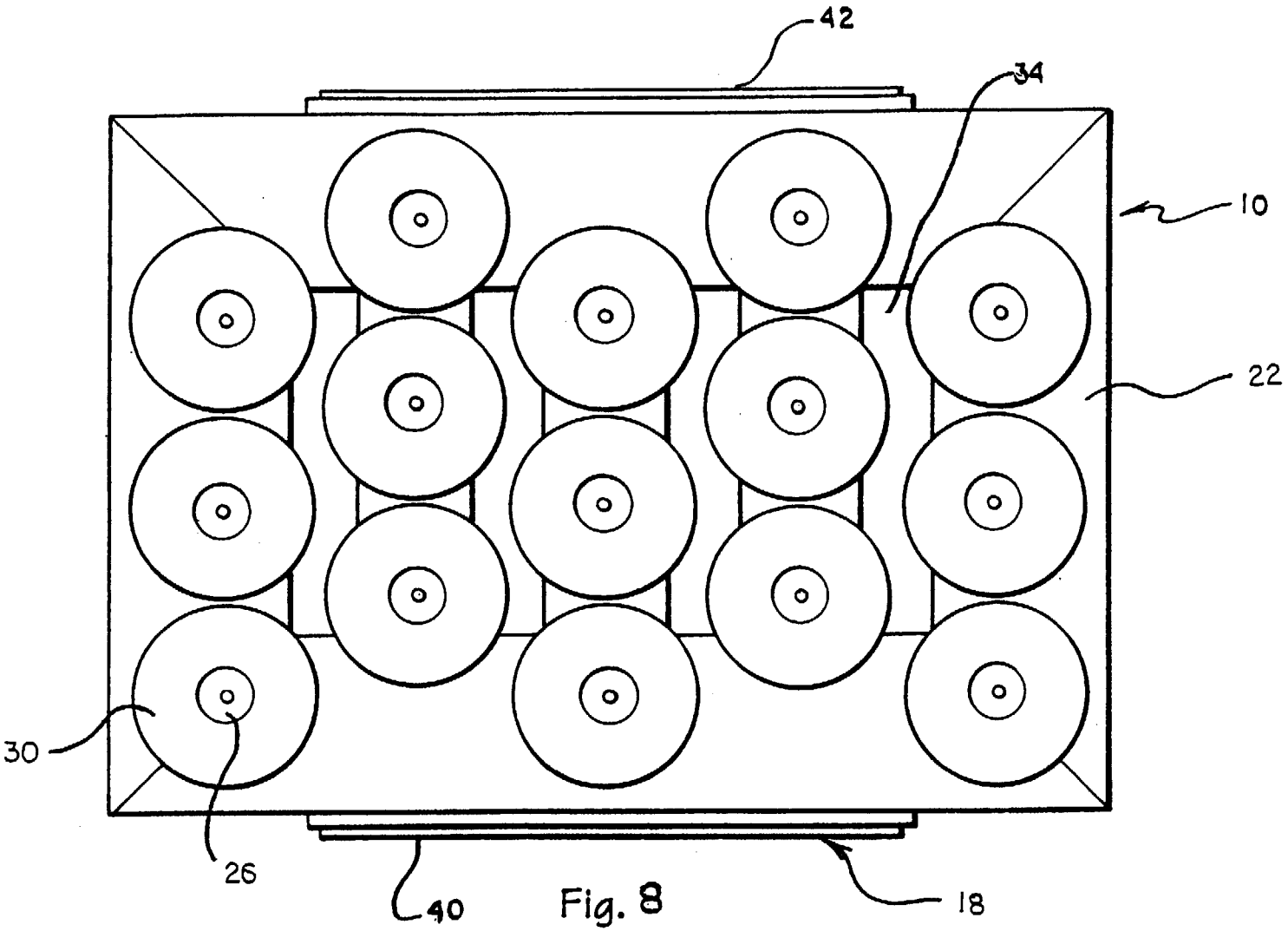
FIG. 8 is a top plan of a carrier having a full complement of textile yarn packages supported therein.
Figure 9:
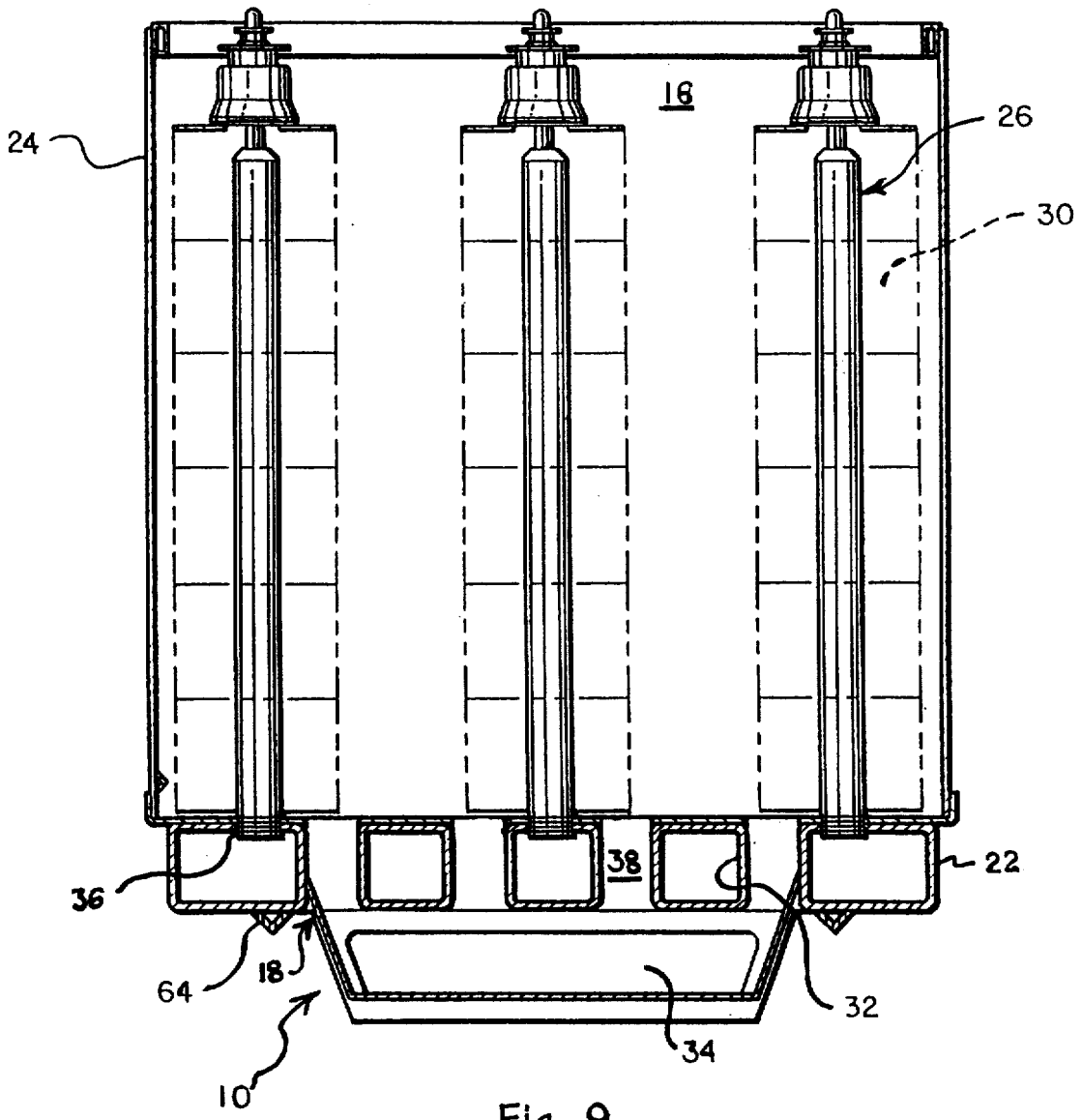
FIG. 9 is a vertical section of the carrier shown in FIG. 7, taken along lines IX—IX thereof.

As seen in FIG. 5, the carrier 1 has a plurality of upstanding tubular posts 26 (only one of which is shown) which are mounted to, and extend upwardly from, the base 22. Each post 26 has a plurality of openings 28 through which liquid flows between the exterior of the post and its hollow interior. Each post 26 is of an outside diameter sized with respect to the inside diameter of a textile yarn package 30 such that a column of the packages 30 can be stacked onto each post 26 to be retained thereby in a vertical column. As seen in FIG. 8, the posts 26 are arranged in longitudinally extending rows spaced to permit non-interfering vertical stacking of the packages 30 thereon.

Each post 26 is operatively interconnected to the liquid flow assembly 18 in a manner, as will be described in more detail below, which permits flow of liquid from the exterior of the packages 30 interiorly to the hollow interior of the post, or alternatively, from the hollow interior of the post outwardly to the exterior of the packages 30.

Figure 6:
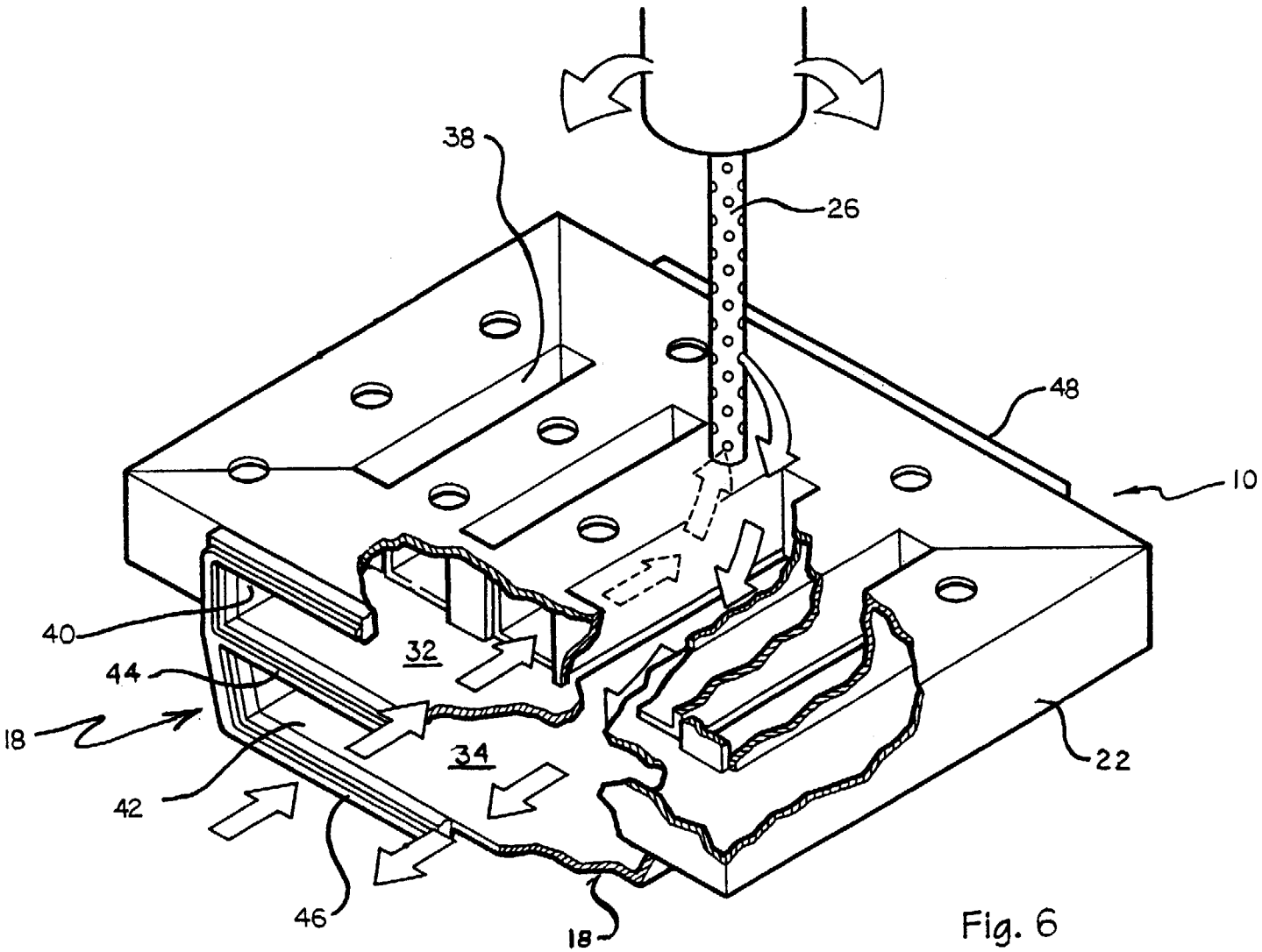
FIG. 6 is an enlarged perspective view, partially broken away, of the base and the flow assembly of the carrier illustrated in FIG. 5.

As seen in FIG. 6, the liquid flow assembly 18 includes two liquid distribution chambers 32,34 formed in the base 22 and communicating with the enclosure 16 formed by the base 22 and wall 24 for delivery of liquid into the enclosure 16 through one of the chambers and withdrawal of liquid from the enclosure through the other of the chambers. Each of the chambers 32,34 extends through substantially the full horizontal extent of the base 22 with one chamber 32 disposed above the other chamber 34. The upper chamber 32 communicates with the interior of the posts 26 through openings 36 formed in the top of the base 22. These openings 36 are internally threaded (not shown) and the bottoms of the posts 26 are externally threaded (not shown) for threaded engagement in support of the posts 26 to extend vertically from the base 22 in a conventional manner. The posts 26 and openings 32 in which they are secured are arranged in spaced rows for support of the packages 30, with the packages staggered in the rows for compact, yet spaced, disposition as illustrated in FIG. 8. With this arrangement, there is liquid communication between the upper chamber 32 and the packages 30 through the openings 36 of the base 22 and the openings 28 in the tubular posts 26.

The lower chamber 34 is separated from the upper chamber 32 by a horizontal wall 44 formed in the base 22. The lower chamber 34 communicates with the space in the enclosure 16 between the packages 30 through elongated passages 38 that extend from the lower chamber 34 upwardly through the upper chamber 32 and opening into the enclosure 16 between the rows of packages 30. In the particular embodiment illustrated, there are five rows of packages 30 mounted on posts 26 and three elongated passages 38 between the package rows.

Each chamber 32,34 has end openings 40,42, respectively, at each end of the base 22 for communicating with corresponding openings of chambers of an adjacent carrier disposed in the vessel or with ports 52,54 of a duct assembly 50 formed in the machine 12 for supplying liquid to and withdrawing liquid from the interior of the machine in a conventional manner. Sealing gaskets 46 are secured around the chamber openings 40,42, including along the end of the divider wall 44, and a corresponding gasket 46 is secured around the duct assembly ports 52,54. These gaskets 46,48 serve to seal the chamber openings 40,42 from the interior of the vessel 20 and sealing between the chambers 32,34 themselves while permitting flow of liquid between corresponding chambers of adjacent carriers 10 and the ports of the duct assembly 50.

The end of the vessel 20 opposite the end at which the duct assembly 50 is located serves as a lid 58 or cover that is hinged to the vessel 20 for opening to load and unload carriers 10 into the machine 12. This lid has, extending from its interior surface, a carrier positioning member 56 that abuts the adjacent carrier 10 and forces the carriers 10 into tight sealing disposition within the vessel 20 and, in doing so, blocks the adjacent end openings 40,42 in the distribution chambers 32,34 of the adjacent carrier to prevent flow of liquid from the chamber ends into the vessel or from one chamber into the other.

With the arrangement as described, flow of treating liquid, such as dye liquor, a bleaching solution, wash water, or other treatment liquid, can be directed either radially outwardly from the interior of the yarn packages 30 through the packages and into the enclosure 16 for withdrawal circulation or can be into the enclosure and radially inwardly through the packages for withdrawal circulation through the posts 26. In this regard, the supply of treating liquid can be directed through the upper port 52 of the duct assembly 50, through the end opening 40 of the upper distribution chamber 32 of the adjacent carrier 10, and thereby through the abutting end openings 40 of the distribution chambers 32 of adjacent carriers for circulation into the second of the carriers 10. The supplied treating liquor then flows upwardly through the openings 28 in the posts 26 and through the packages 30 for treatment of the yarn thereon. Ultimately, the treating liquid flows from the packages 30 into the enclosure 16 from which it is withdrawn for recirculation through the passages 38 of the lower distribution chambers and then from the lower distribution chambers through the lower port 54 of the duct assembly 50 (FIGS. 5 and 6).

Figure 7:
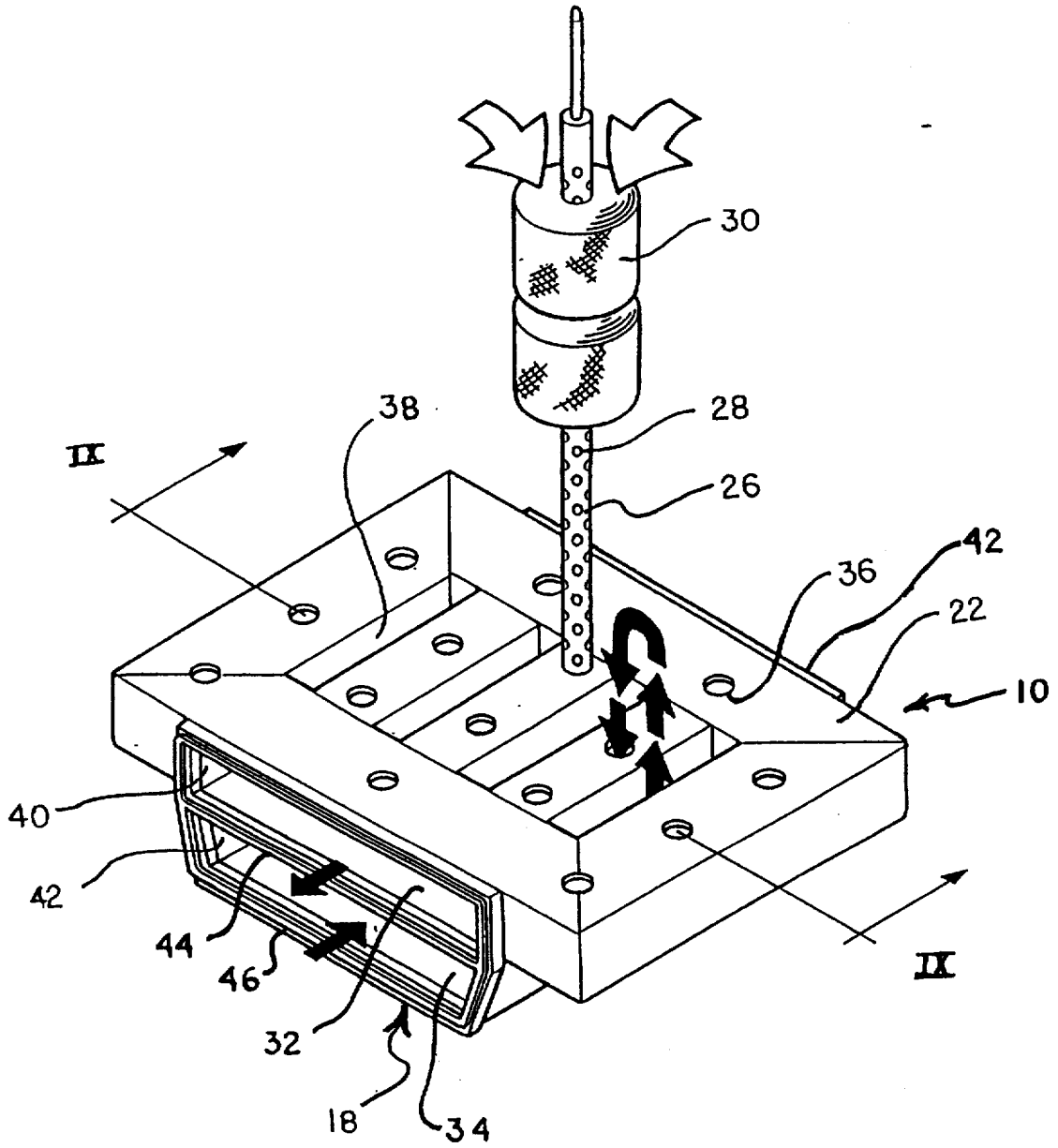
FIG. 7 is a perspective view of the base and flow assembly of a carrier illustrated in FIG. 1 during a reverse liquid circulation operation in which the flow of liquid to the carrier is through the lower liquid distribution chambers and away from the carrier through the upper liquid distribution chamber thereof.

Alternatively, the flow can be in a reverse direction wherein the supply of liquid is fed through the lower port 54 of the duct assembly 50 into the lower distribution chambers 34 of the carriers 10 and then upwardly through the passages 38 into the enclosure 16. The liquid then is drawn radially inwardly through the packages 30 to the openings 28 in the posts 26 through which the liquid flows downwardly into the upper distribution chamber 32 and therefrom through the upper port 52 of the duct assembly 50 (FIG. 7).

With the system as described above, each carrier 10 forms an individual fluid bath containing enclosure 16 that is of a minimum volume as the walls 24 of the carriers 10 are closely adjacent the stacked packages 30 and no significant unused space is required for the bath as is the case when packages are dyed conventionally in a horizontal dyeing machine where there is considerable space at the sides, ends, and bottom of the vessel that must be filled with treating liquid that adds considerably to the volume of treating liquid need per pound of yarn being treated. This advantage results as well, but to a lesser extent, when compared with a horizontal dyeing machine that has interior walls secured therein adjacent the packages, thereby reducing the unused space to the sides of the carriers, but not to the same extent as with the walled carriers 10 of the present invention and does not reduce the unused space at the ends and bottom of the vessel, thereby requiring more treating fluid per pound of yarn being treated than is necessary with the present invention.

The incorporation of two separate distribution chambers 32,34 in the present invention also facilitates the foregoing advantage in that it results in circulation of the fluid, both supply and withdrawal, in the carriers rather than having the withdrawal being from the bottom of the vessel as in conventional machines.

Figure 10:
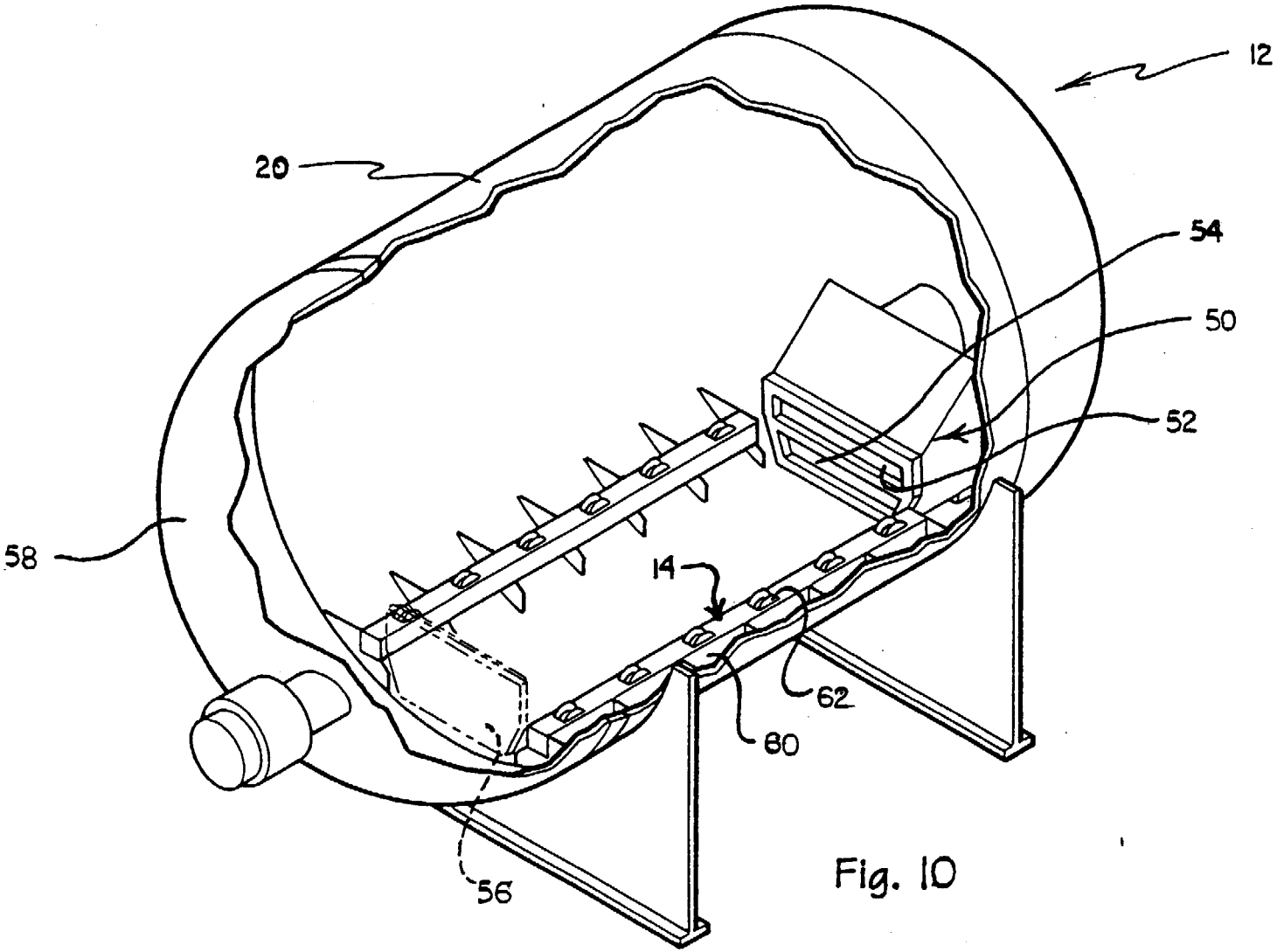
FIG. 10 is a perspective view, partially broken away, of the vessel of the horizontal dyeing machine shown in FIG. 3 and showing details of the vessel duct assembly.
Figure 11:
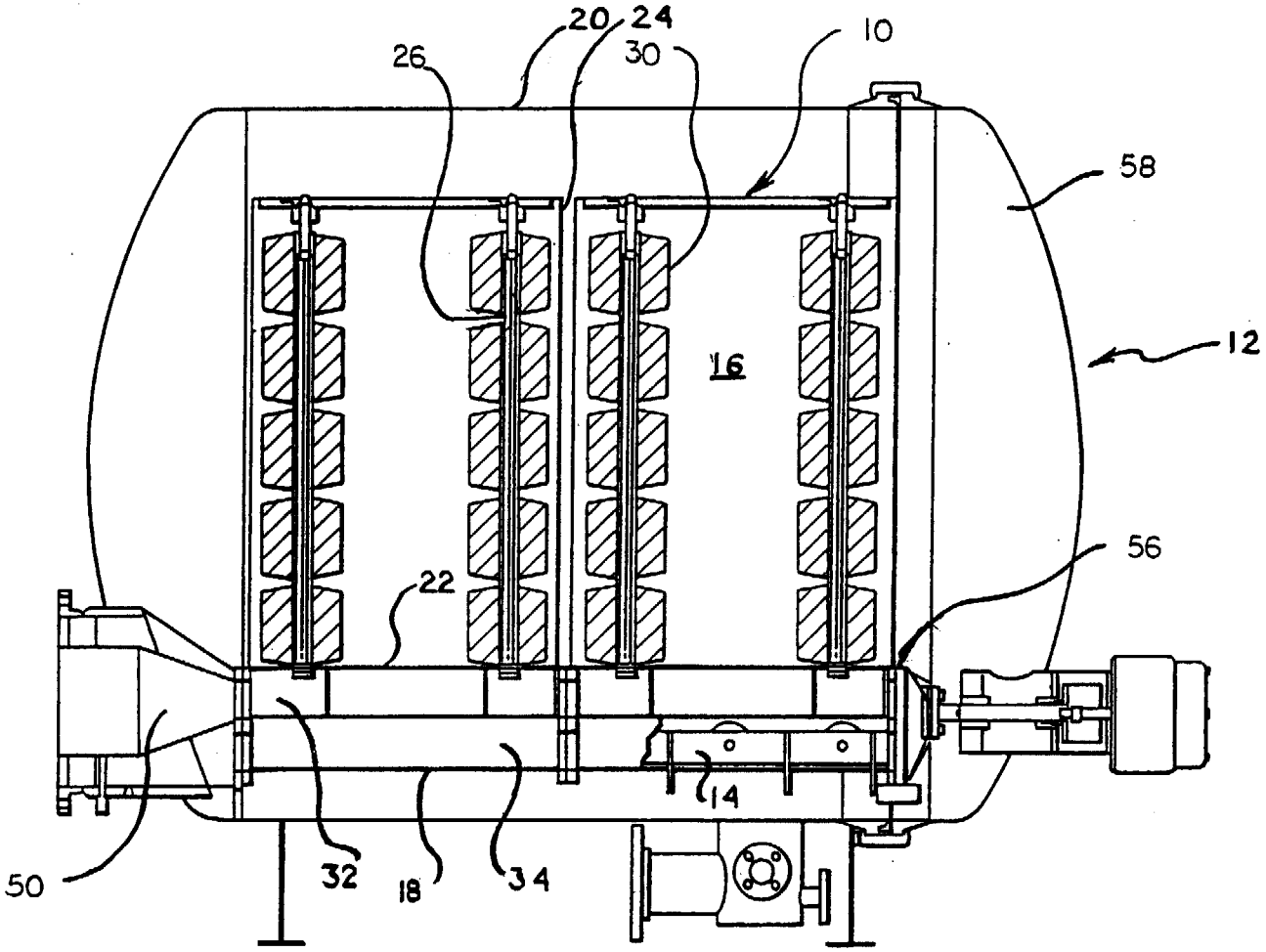
FIG. 11 is a vertical section of the vessel and a pair of the carriers shown in FIG. 4.
Figure 12:
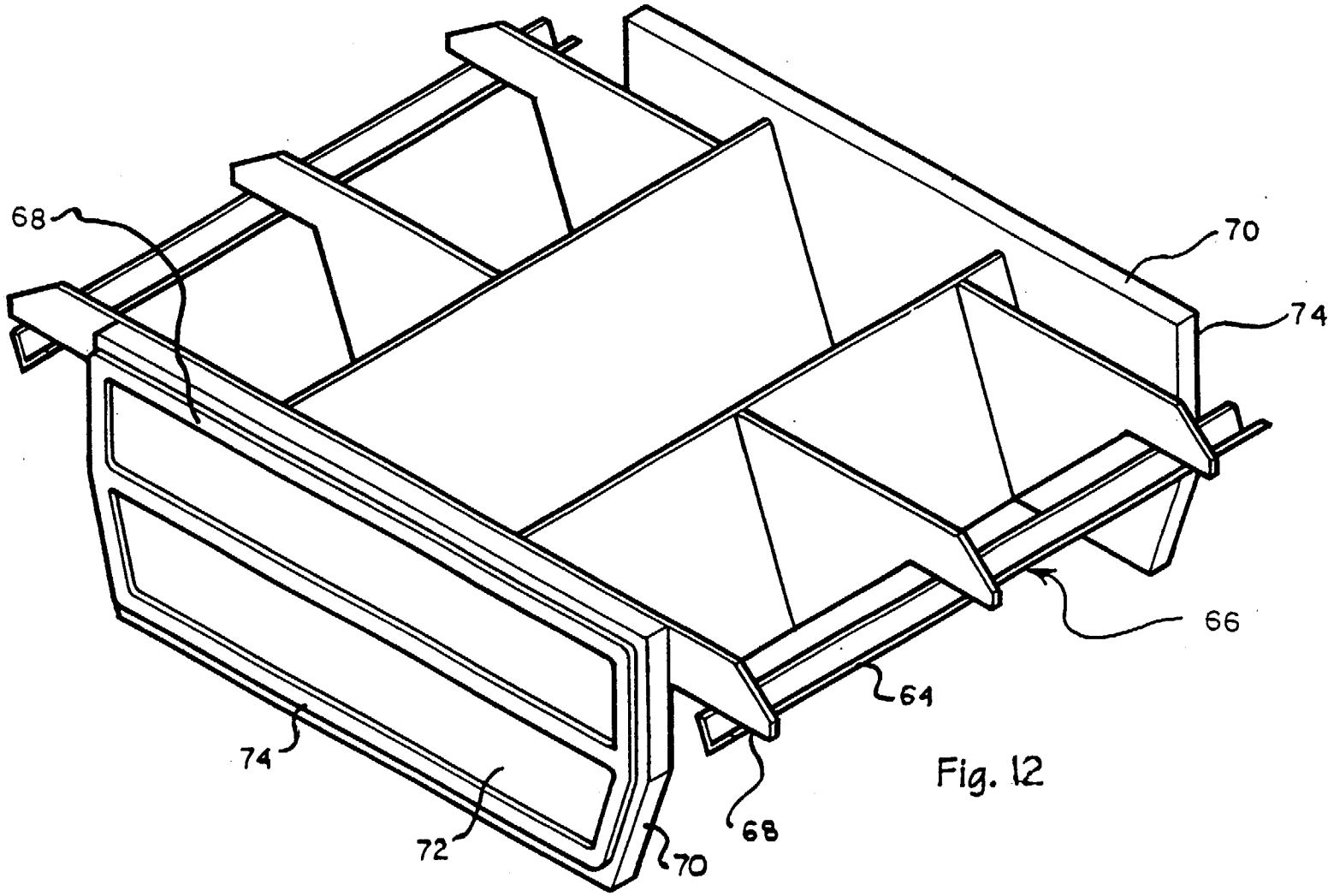
FIG. 12 is a perspective view of a flow blocking insert member according to the preferred embodiment of the present invention.
Figure 13:
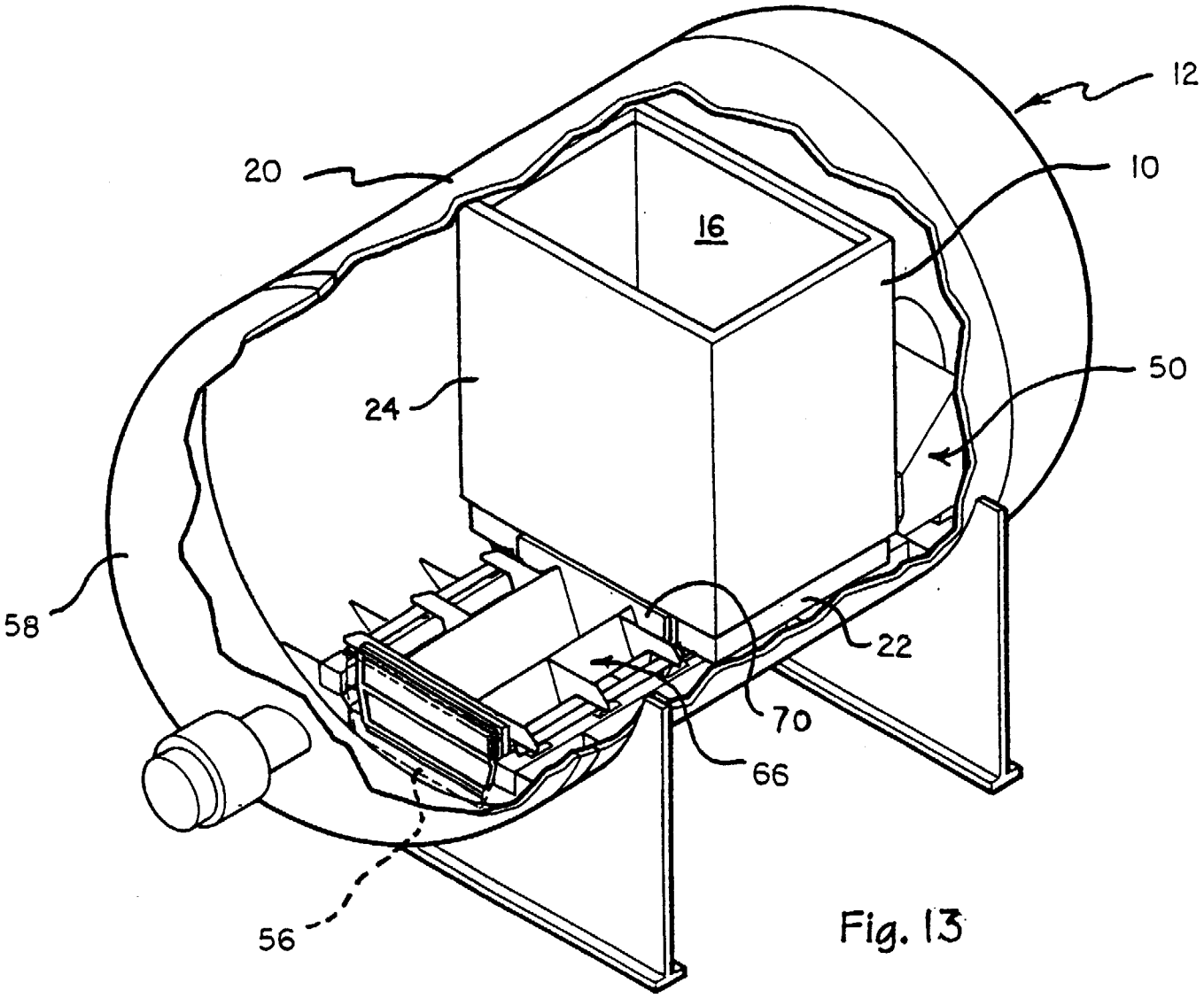
FIG. 13 is a perspective view, partially broken away, of the vessel of a horizontal dyeing machine illustrated in FIG. 1 and showing a flow blocking insert member and carrier disposed in the vessel.

As seen in FIG. 1, the transport assembly 14 is of conventional design for transporting the independently movable carriers 10 to and between an arrangement of horizontal dyeing machines. As seen in FIGS. 2 and 10, the track assembly 14 includes a plurality of rails 60 arranged in pairs with each rail pair extending longitudinally into a respective one of the vessels 20. Each vessel rail 60 includes a plurality of freely rotatably V-grooved rollers 62 which cooperate with a complementary V-shaped flange 64 mounted on the underside of the base member 22 of each carrier 10. Each carrier 10 is provided with a pair of the V-shaped flanges 64 in parallel, spaced apart relationship corresponding to the spacing of a pair of the vessel rails 60 in a vessel 20. Each V-shaped flange 64 is engaged in the V-shaped grooves of the rollers 62 for rolling of the carriers into and out of the vessels 20.

In the embodiment illustrated, the carriers 10 are dimensioned so that two identical carriers take up the full capacity of a dyeing machine 12 being clamped between the duct assembly ports 52,54 and the carrier positioning member 56. In this way, the two carriers can combine to carry a full load of packages to the full capacity of the machine 12. Of course, the carriers can be dimensioned so that one carrier is of a size to occupy the full capacity of a dyeing machine or can be sized in increments such that a different multiple of carriers or combination of different sizes of carriers can be utilized to occupy in combination the full capacity of the machine.

An advantage of using carriers that each occupy less than the full capacity of the machine and are of the self-contained form of the present invention is that the machines can be utilized efficiently and effectively when less than a full batch of yarn packages is to be treated. It is particularly advantageous when all the carriers are of a size that a multiple of identical carriers will fit in the machine. For example, in the embodiment illustrated, each carrier 10 is of a size equivalent to half the capacity of the machine so that dye batches or other batches to be treated of half or less the full capacity of the machine can be treated in a self-contained carrier within the machine. To accomplish this by eliminating the need for a second, empty carrier to be used when treating a half batch or less, the present invention provides for the use of an insert member 66 in the form of a frame 68 having the same lengthwise extent as the base 22 of a carrier 10 and having ends 70 dimensioned to be the same size and shape as the ends of the base 22 of the carrier 10 to provide blocking surfaces 72 for abutting against the openings 40,42 of the distribution chambers 32,34 of the base 22 of the carrier 10, having a similar ceiling gasket 74 for mating with the gaskets 46,48 of the distribution chamber openings 40,42 to prevent escape of liquid from the distribution chamber and openings into the vessel interior and to prevent flow of liquid between chambers at the end openings.

Being of the same size and shape as the distribution chamber ends, one end 70 of the insert member 70 will be in position for abutment by the carrier positioning member 56 when the lid 58 of the vessel 20 is closed, thereby clamping the insert member 66 in the position normally occupied by a carrier 10 so that the machine can be operated to treat a half batch of yarn packages in a single carrier 10 efficiently and effectively without waste of treating liquid.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A carrier for supporting textile material in a horizontal wet treatment machine of the type having a cylindrical vessel into which carriers supporting textile material for treatment are transported horizontally, the carrier comprising:

a base for supporting textile material thereon;

a substantially vertically oriented wall mounted on and extending upwardly from the periphery of said base and fixed in a noncontacting closely adjacent relationship with textile material supported therein and forming with said base an enclosure for confining therewithin treating liquid for treating textile material supported therein by providing the free flow of treating liquid therearound; and a liquid flow assembly for receiving and discharging treating liquid for circulation into and out of said carrier.

2. A carrier according to claim 1 wherein said liquid flow assembly has a plurality of openings, and said carrier further comprises a plurality of hollow tubes vertically mounted on said base with each tube in communication with a respective opening and each tube having a plurality of openings through which liquid flows between the hollow interior of the tube and the exterior of the tube.

3. A carrier according to claim 1 wherein the vessel has a capacity for wet treating a predetermined amount of textile material and said base and said wall are dimensioned to support a load of textile material less than the predetermined load of textile material which the vessel is capable of treating.

4. A carrier according to claim 3 wherein the carrier is dimensioned with respect to the vessel such that the carrier and at least a second carrier are disposable in the vessel for simultaneous treatment of textile material supported on the carriers.

5. A carrier according to claim 1 wherein said liquid flow assembly comprises two liquid distribution chambers formed in said base and communicating with the enclosure formed by said base and wall for delivery of liquid into the enclosure through one of said chambers and withdrawal of liquid from the enclosure through the other of said chambers.

6. A carrier according to claim 5 and characterized further by a textile material support assembly mounted on said base for support of textile material thereon and having openings therein, and one of said distribution chambers communicates interiorly with said support assembly openings for passage of liquid therethrough.

7. A carrier according to claim 6 and characterized further in that said support assembly comprises a plurality of tubular posts secured to and extending upwardly from said base with said openings therein, and said one distribution chamber communicates with said posts for passage of liquid through said post openings.

8. A carrier according,to claim 7 and characterized further in that said one distribution chamber is disposed above the other distribution chamber with said other chamber having passages extending upwardly through said one chamber and opening into the enclosure for passage of liquid between said other chamber and the enclosure.

9. A carrier according to claim 8 and characterized further in that said posts are arranged in spaced rows and said passages of said other chamber are disposed between said rows.

10. A carrier according to claim 5 and characterized further in that said distribution chambers are open at the ends of said base for communicating with corresponding machine ducts and with chambers of an adjacent carrier disposed in the vessel.

11. A carrier for supporting textile material in a horizontal wet treatment machine of the type having a cylindrical vessel into which carriers supporting textile material for treatment horizontally are transported horizontally, the carrier comprising:

a base;

a support assembly mounted on said base for supporting textile material thereon; and a liquid flow assembly for receiving and discharging treating liquid for circulation into and out of said carrier, said liquid flow assembly comprises two distribution chambers formed in said base and communicating therethrough for delivery of liquid through one of the chambers and withdrawal of liquid through the other of said chambers.

12. A carrier according to claim 11 and characterized further in that said support assembly has openings therein, and one of said distribution chambers communicates interiorly with said support assembly openings for passage of liquid therethrough.

13. A carrier according to claim 12 and characterized further in that said support assembly comprises a plurality of tubular posts secured to and extending upwardly from said base with said openings therein, and said one distribution chamber communicates with said posts for passage of liquid through said post openings.

14. A carrier according to claim 13 and characterized further in that said one distribution chamber is disposed above the other distribution chamber with said other chamber having passages extending upwardly through said one chamber and opening through said base for passage of liquid therethrough.

15. A carrier according to claim 14 and characterized further in that said posts are arranged in spaced rows and said passages of said other chamber are disposed between said rows.

16. A carrier according to claim 11 and characterized further in that said distribution chambers are open at the ends of said base for communicating with corresponding machine ducts and with chambers of an adjacent carrier disposed in the vessel.

17. A combination of a carrier for supporting textile material in a horizontal wet treatment machine and an insert member wherein the machine has fluid delivery and discharge ports at one end and a positioning member at the other end, said combination comprising:

a carrier having a base dimensioned for supporting textile material thereon and having a lengthwise extent less than the distance between the ports of the machine and the positioning member, a wall mounted on and extending upwardly from the periphery of said base and forming therewith an enclosure for confining therewithin treating liquid for treating textile material supported therein, and a liquid flow assembly for receiving and discharging treating liquid for circulation into and out of said carrier said liquid flow assembly including two liquid distribution chambers formed in said base and communicating with the enclosure formed by said base and wall for delivery of liquid into the enclosure through one of said chambers and Withdrawal of liquid from the enclosure through the other of said chambers, said distribution chambers being open at the ends of said base for communicating with the machine ports at one end and at the other end capable of communicating with distribution chambers of another carrier when two carriers are positioned in the machine for simultaneous textile material treatment in both carriers, and an insert member having a lengthwise extent sufficient to position said carrier against the machine ports when said insert member is disposed between said carrier and the positioning member of the machine, and a flow blocking surface disposed against the open other ends of the distribution chambers to block flow of liquid therefrom.

18. The combination of claim 17 and characterized further in that each said carrier and said insert member have the same lengthwise extent equivalent to one half the distance between the machine ports and the positioning member.

* * * * *

UNITED STATES PATENT AND TRADEMARK OFFICE

CERTIFICATE OF CORRECTION

PATENT NO. : 5,410,892

DATED : May 2, 1995

INVENTOR(S) : Robert L. Catoe; Matthew A. Meeker; James K. Turner; Thomas W. Van Scyoc

It is certified that error appears in the above-identified patent and that said Letters Patent is hereby corrected as shown below:

Column 4, line 16, delete "FIGS. 1-20" and insert therefor -- FIGS. 1-13 --.

Column 4, line 40, delete "carrier 1" and insert therefor -- carrier 10 --.

Column 4, line 57, after "or" insert -- , --.

Column 6, line 29, delete "need" and insert therefor -- needed --.

Column 7, line 30, delete "ceiling" and insert therefor -- sealing --.

Column 7, line 36, delete "insert member 70" and insert therefor -- insert member 66 --.

Column 8, line 53, after "according" delete ",".

Column 10, lines 20-21, delete "Withdrawal" and insert therefor -- withdrawal --.

Signed and Sealed this

Twenty-sixth Day of March, 1996

Bruce Lehman

*Attest:*

BRUCE LEHMAN

*Attesting Officer*

*Commissioner of Patents and Trademarks*